US005090456A

United States Patent [19]

Kasahara

[11] Patent Number: 5,090,456

[45] Date of Patent: Feb. 25, 1992

[54] WEFT GRIPPING AND CUTTING APPARATUS IN RAPIER LOOM

[75] Inventor: Junya Kasahara, Kanazawa, Japan

[73] Assignee: Tsudakoma Corp., Ishikawa, Japan

[21] Appl. No.: 593,014

[22] Filed: Oct. 4, 1990

[30] Foreign Application Priority Data

Oct. 4, 1989 [JP] Japan ..... 1-258999

[51] Int. Cl.[5] ..... D03D 47/34

[52] U.S. Cl. ..... 139/302; 139/303; 139/291 C; 139/453

[58] Field of Search ..... 139/453, 291 C, 302, 139/303, 438

[56] References Cited

U.S. PATENT DOCUMENTS 4,840,203 6/1989 Moeneclaey et al. ..... 139/453

4,913,195 4/1990 Speich ..... 139/453 X

*Primary Examiner*—Andrew M. Falik

*Attorney, Agent, or Firm*—Wenderoth, Lind & Ponack

[57] ABSTRACT

A picking apparatus of a rapier loom has gripping bodies between a weft selection device and a yarn cutter. The gripping bodies are movable up and down. The gripping bodies selectively grip a plurality of weft yarns in accordance with a color pattern. One yarn cutter cuts the weft yarn gripped by the gripping bodies and severs the cut weft yarn from a woven cloth after the weft yarn is picked. Thus, neither catch cords nor an extra length of fringe nor a selvage cutter are needed.

7 Claims, 12 Drawing Sheets

1 x 1 WEAVING TEXTURE 2 x 2 WEAVING TEXTURE

FIG.13

| | | SOLENOID 41 | SOLENOID 42 |
|---|---|---|---|
| POSITION 1 OF SLIDER 4 | SWITCHING SIGNAL K1 | OFF | OFF |
| POSITION 2 OF SLIDER 4 | SWITCHING SIGNAL K2 | OFF | ON |
| POSITION 3 OF SLIDER 4 | SWITCHING SIGNAL K3 | ON | OFF |

FIG.14

| PICKING CYCLE | WEFT YARN | OUTPUT PERIOD OF SWITCHING SIGNAL | SWITCHING SIGNAL |
|---|---|---|---|
| 1 | 9a | 6°~126° | K2 |
| | | 126°~6° | K3 |
| 2 | 9b | 6°~126° | K2 |
| | | 126°~6° | K1 |
| 3 | 9a | 6°~126° | K2 |
| | | 126°~6° | K3 |
| 4 | 9b | 6°~126° | K2 |
| | | 126°~6° | K1 |
| 5 | 9b | 6°~126° | K2 |
| | | 126°~6° | K1 |

WEFT GRIPPING AND CUTTING APPARATUS IN RAPIER LOOM

BACKGROUND OF THE INVENTION

1. Field of the Invention

The present invention relates to a picking apparatus of a rapier loom, particularly to an improvement in a device for gripping and cutting a weft yarn prior to each picking operation.

2. Prior Art

A known rapier loom provides catch cords outside a selvage of a woven cloth which hold a picked weft yarn while the picked weft yarn is connected to a yarn package. The weft yarn is cut by a yarn cutter between the catch cords and a rapier prior to the next picking operation of the weft yarn. Then the weft yarn is picked. The weft yarn end held by the catch cords is cut from the selvage of the woven cloth by a selvage cutter and is thrown away with the catch cords.

The catch cords are necessitated for holding the weft yarn during the picking operation in the rapier loom, which entails the loss of the weft yarn held thereby, i.e., the extra length of fringe. Furthermore, a yarn cutter and a selvage cutter which are liable to fail are provided. Thus, special attention is required for the maintenance and inspection thereof.

SUMMARY OF THE INVENTION

It is therefore an object of the present invention to provide a picking apparatus of a rapier loom capable of eliminating catch cords which entail a loss of the weft yarn and the selvage cutter.

To achieve the above object, the picking apparatus of the rapier loom comprises first and second opposed gripping bodies respectively movable up and down, urged toward a middle position thereof and disposed between a weft selection device and a yarn cutter, and a slider having a gripper movable up and down by a driving means between the first and the second gripping bodies, whereby a plurality of weft yarns can be selectively gripped according to a color pattern and the gripped weft yarns can be cut by the yarn cutter.

The driving means moves the slider up and down in accordance with the color pattern so that the gripper of the slider is driven up and down between the pair of gripping bodies. With the vertical motion of the slider, the gripper of the slider moves into contact or away from the upper gripping body or the lower gripping body relative to the middle position of the gripping bodies, thereby selectively gripping the weft yarn. When the weft yarn is gripped, the yarn cutter cuts the weft yarn before the picking operation to sever the weft yarn from the woven cloth.

The slider comprises, in a preferred embodiment, a movable blade of the yarn cutter which cuts the weft yarn together with a fixed blade.

At the middle position of the slider, the gripper of the slider and both the gripping bodies contact each other, i.e. the middle position is one at which the two weft yarns can be gripped at the same time between the gripper of the slider and both of the gripping bodies.

According to the present invention, the picked weft yarn is gripped by the first gripping body and the gripper of the slider or the second gripping body and the gripper of the slider outside the picking side selvage of the woven cloth and is cut by the yarn cutter, provided between the gripping bodies and the woven cloth, under an appropriate timing which results in eliminating the catch cords and generating no extra length of fringe. Accordingly, the loss of the weft yarn can be saved to a great extent and no selvage cutter is necessitated, due to the nonexistence of the extra length fringe. As a result, the weft yarn can be cut by only one yarn cutter, whereby the cutter which is troublesome to maintain and inspect and the time and labor involved in such maintenance and inspection are obviated.

The above and other objects, features and advantages of the present invention will become more apparent from the following description taken in conjunction with the accompanying drawings.

BRIEF DESCRIPTION OF THE DRAWINGS

FIGS. 13 and 14 are tables of switching signals;

PREFERRED EMBODIMENTS OF THE PRESENT INVENTION

First Embodiment (FIGS. 1 to 7)

Figure 1:
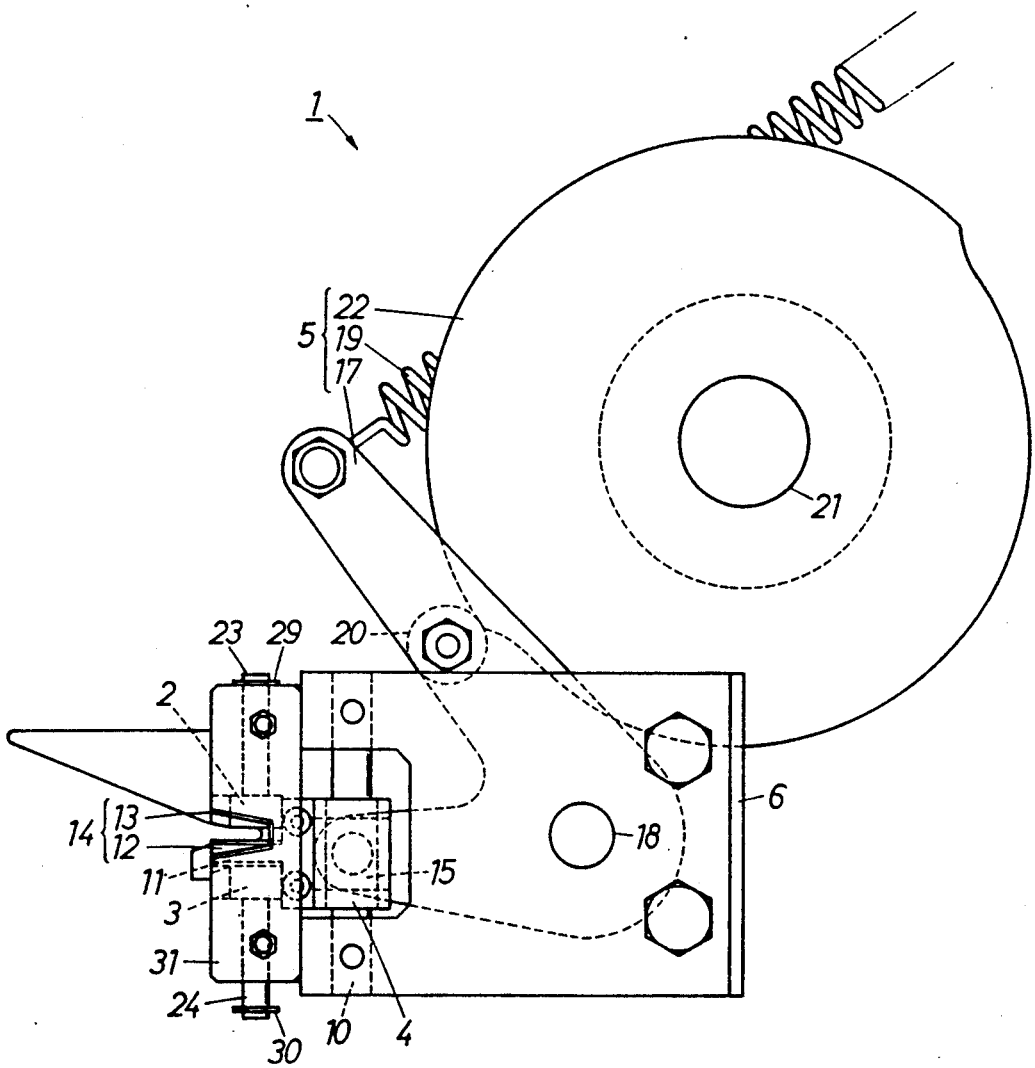
FIG. 1 is a side elevational view of a picking apparatus of a rapier loom according to a first embodiment of the present invention.

A picking apparatus of a rapier loom according to a first embodiment of the present invention will be described with reference to FIGS. 1 to 7.

A picking apparatus 1 of a rapier loom comprises, as illustrated in FIGS. 1 to 4, first and second gripping bodies 2, 3, a block shaped slider 4 and a driving means 5. These elements 2, 3, 4 and 5 are incorporated in first and second brackets 6, 7. That is, the first bracket 6 is attached to a loom frame, not shown, between fingers 8a, 8b of a weft selection device and a woven cloth 9. A slider shaft 10 extends vertically through an open front end portion of the bracket 6. The bracket 6 supports the slider 4 such that the slider 4 is vertically movable along the slider shaft 10.

The slider 4 has a gripper 11 at the front central portion thereof. The gripper 11 has a movable blade 12 at the side of a woven cloth 9. The movable blade 12 and a fixed blade 13 described later constitute a yarn cutter 14. The slider 4 is connected to one end of a cam lever 17 via a slide piece 15 and a connecting pin 16. The slide piece 15 is horizontally movable in a groove extending horizontally in the slider at the side of the weft selection device. And, the connecting pin 16 is inserted into the slide piece 15.

Figure 5:
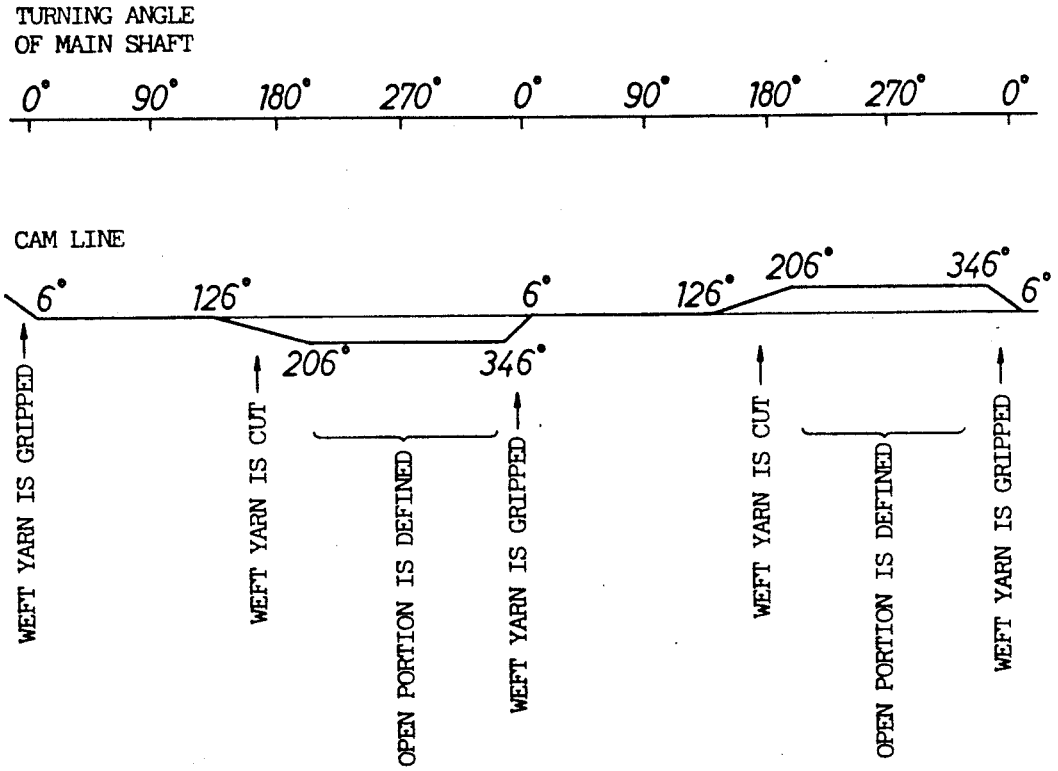
FIG. 5 is a timing diagram showing a cam line relative to a turning angle of a main shaft of the rapier loom in FIG. 1.

The cam lever 17 is substantially L-shaped and is rotatably supported by the first bracket 6 about a lever shaft 18 at the base end thereof. The cam lever 17 is urged clockwise in FIG. 1 by a drawing spring 19 and is positioned by a rotatable plate-like cam 22 via a cam ball 20 provided at the central portion of the lever 17. The contour of the cam 22 is determined as illustrated in FIG. 5 relative to the turning angle of the main shaft of the loom. The cam 22 is rotatably supported by a cam shaft 21, the rotation of which is based on a color pattern 1×1 in which two yarns are successively picked one after the other according to the first embodiment of the present invention. The cam shaft 21 rotates in synchronism with the main shaft of the loom and the reduction gear ratio of the cam shaft 21 relative to the main shaft of the loom is set to be 1:2. The cam lever 17 and the cam 22 constitute the driving means 5.

The second bracket 7 is attached to the front end surface of bracket 6 and holds the two gripping bodies 2, 3 such that the two gripping bodies 2, 3 are movable up and down toward guide holes 27, 28 of the second bracket 7. The gripping bodies 2, 3 are integrated with guide shafts 23, 24 and vertically confront each other with the gripper 11 of the slider 4 interposed therebetween. Compressed springs 25, 26 extend around the guide shafts 23, 24 to urge the gripping bodies 2, 3 toward the gripper 11 so that the gripping bodies 2, 3 always contact the gripper 11 at a middle position thereof. The upper guide shaft 23 is restricted from moving downward by a stop ring 29 attached to the upper end thereof and the lower guide shaft 24 is restricted from moving upward by a stop ring 30 attached to the lower end thereof. A yarn guide 32 is attached o the side surface of the second bracket 7, i.e., at the side of the fingers 8a, 8b of the weft selection device. The yarn guide 32 has a yarn introduction slit 33 open at a side thereof where let-off motion of the loom occurs. The yarn guide 32 is attached to the second bracket 7 so that the yarn introduction slit 33 is horizontally flush with the open spaces which are to be formed between the gripping bodies 2, 3 and the gripper 11 of the slider 4.

The second bracket 7 has an opening at the front side thereof of the same size as the open end of the first bracket 6 and is integrated with a fixed blade bracket 31 at the open end thereof. The fixed blade bracket 31 has a fixed blade 13 defining a V-shaped opening at the inside front portion thereof and is attached to the side surface of the bracket 7 at the side of the woven cloth 9. The fixed blade 13 contacts the movable blade 12 so as to bring about the shearing of the weft yarn.

Figure 2:
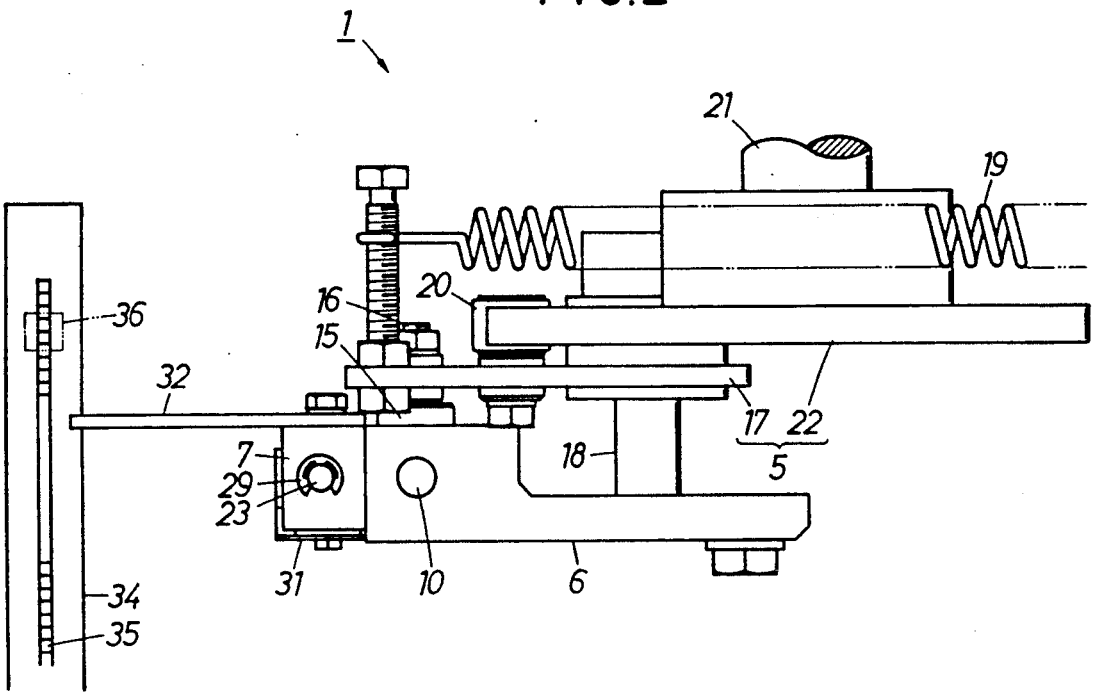
FIG. 2 is a plan view of the picking apparatus in FIG. 1.
Figure 3:
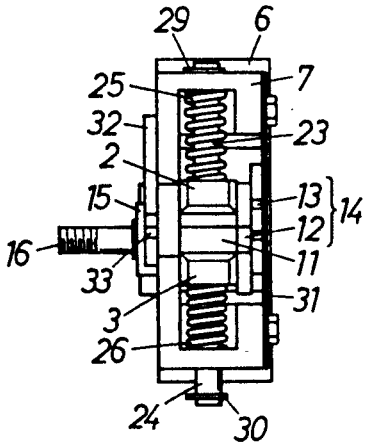
FIG. 3 is a front elevational view of a part of the picking apparatus in FIG. 1.
Figure 4:
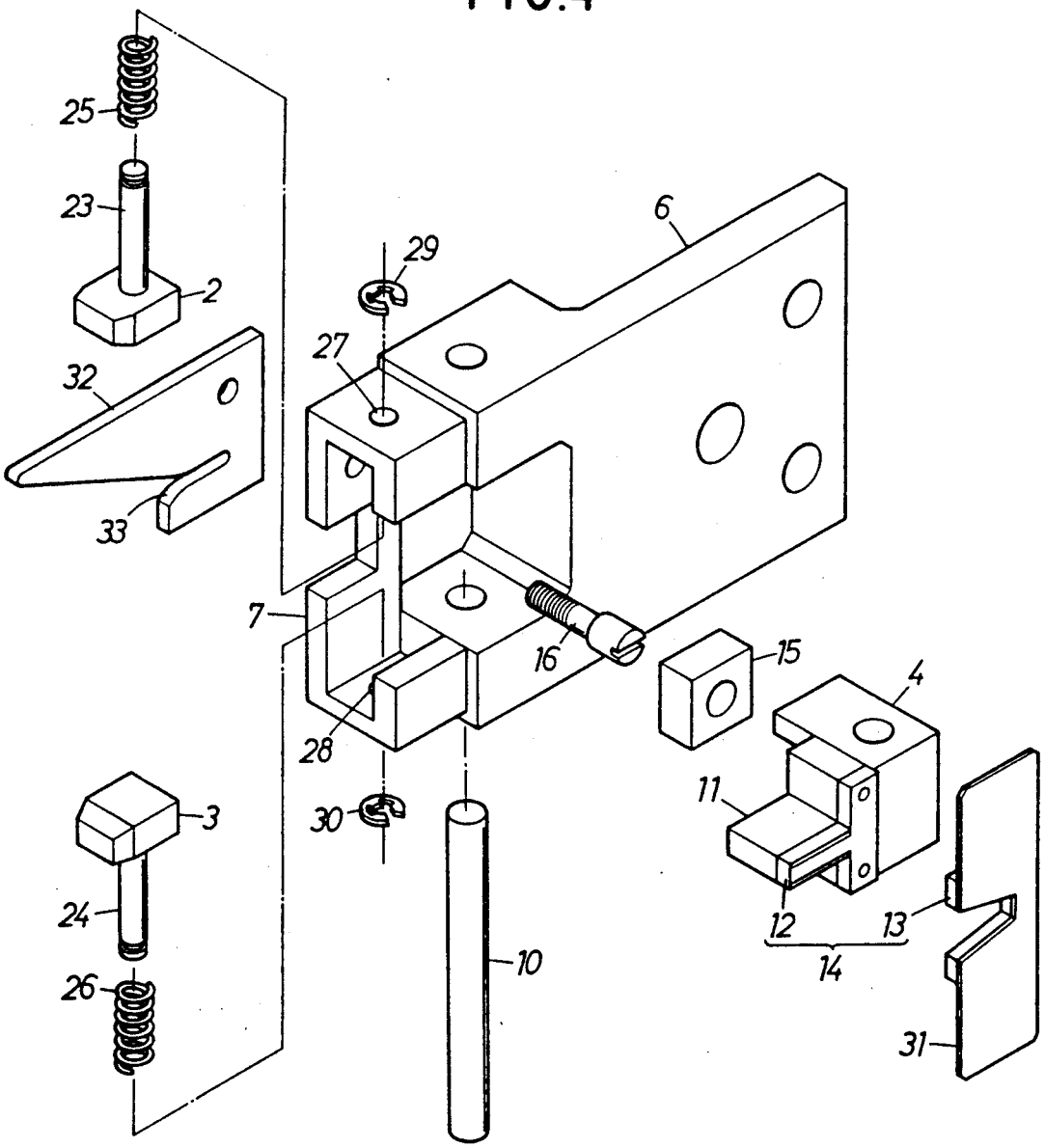
FIG. 4 is an exploded perspective view showing a principal portion of the picking apparatus in FIG. 1.
Figure 6:
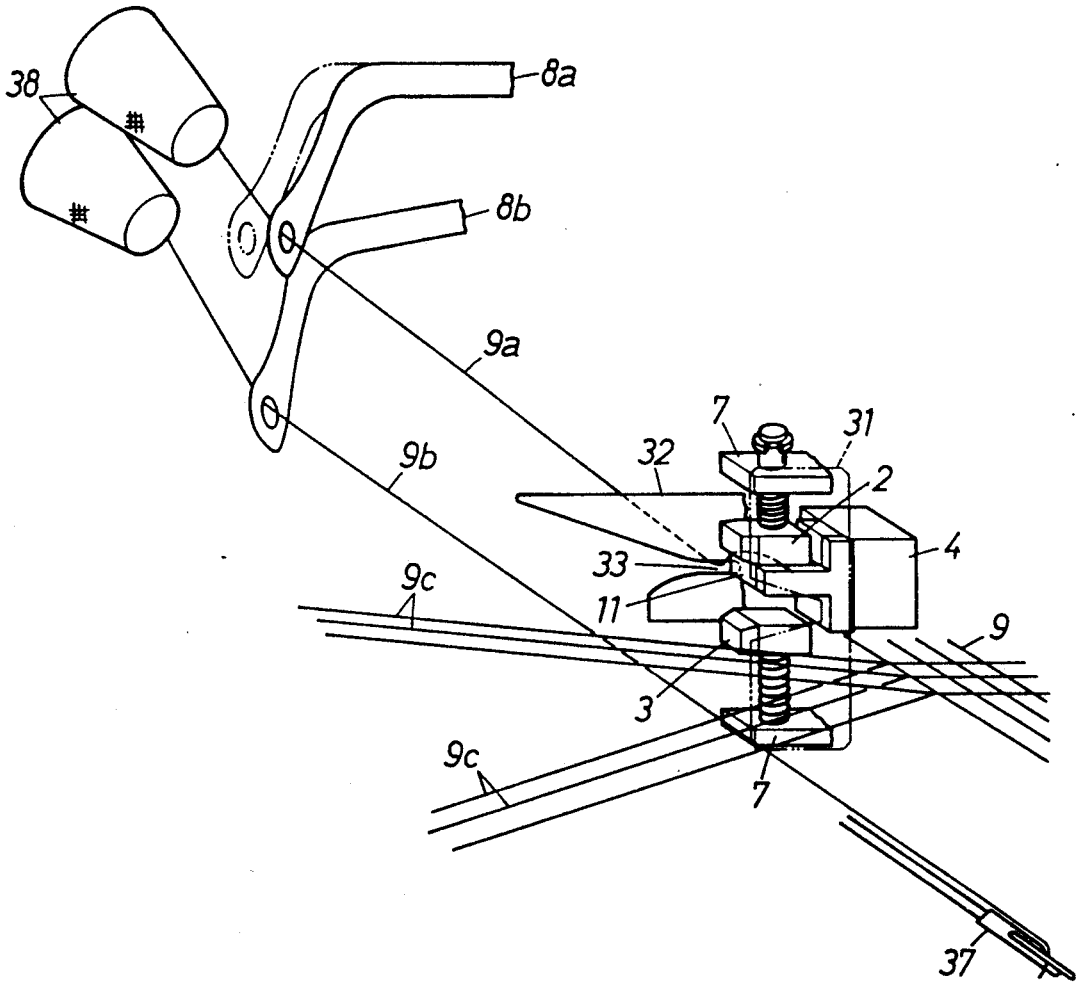
FIG. 6 is a perspective view showing a disposition of the principal portion of the picking apparatus in FIG. 4.

The first bracket 6 is positioned, as illustrated in FIGS. 1, 2 and FIG. 6, such that the yarn cutter 14 is close to the selvage of the woven cloth 9 and such that the yarn introduction slit 33 is flush with the pane in which the cloth fell of the woven cloth 9 lies. Consequently, the first and the second griping bodes 2, 3 are movable up and down at the position where they cross the pane in which the cloth fell lies. The picking apparatus 1 confronts a reed 35 on a sley 34 and the part of the picking apparatus 1 between the yarn guide 32 and the fixed blade bracket 31 confronts the opening of the reed 35.

When the cam shaft 21 is rotated while interlocked with the main shaft of the loom, the cam lever 17 swings in proportion to the contour of the cam 22 to thereby move the slider 4 up and down whereby the gripper 11 of the slider 4 moves up and down between the first and the second griping bodies 2, 3. The gripping bodies 2, 3 move up and down against the resilience force of the compressed springs 25, 26 while following the vertical motion of the gripper 11. When the slider 4 assumes its uppermost position, the first gripping body 2 maintains contact with the gripper 11 while a space is defined between the second gripping body 3 and the gripper 11. When the slider 4 assumes its lowest position, the second gripping body 3 maintains contact with the gripper 11 while a space is defined between the first griping body 2 and the gripper 11. When the slider 4 only contacts one of the gripping bodies 2, 3, the space defined therebetween is located along the plane in which the cloth fell lies. When the slider assumes its middle position, the gripper 11 contacts both the first and the second griping bodies 2, 3.

When the slider 4 moves from the middle position to the uppermost position or to the lowest position, the yarn cutter 14 can cut the weft yarn gripped by the gripper 11 and the first gripping body 2 or by the gripper 11 and the second griping body 3. The slider 4 is, at the middle position thereof, in a state where the gripper 11 contacts the first and the second gripping bodies 2, 3 and two weft yarn 9a, 9b are gripped therebetween.

Figure 7:
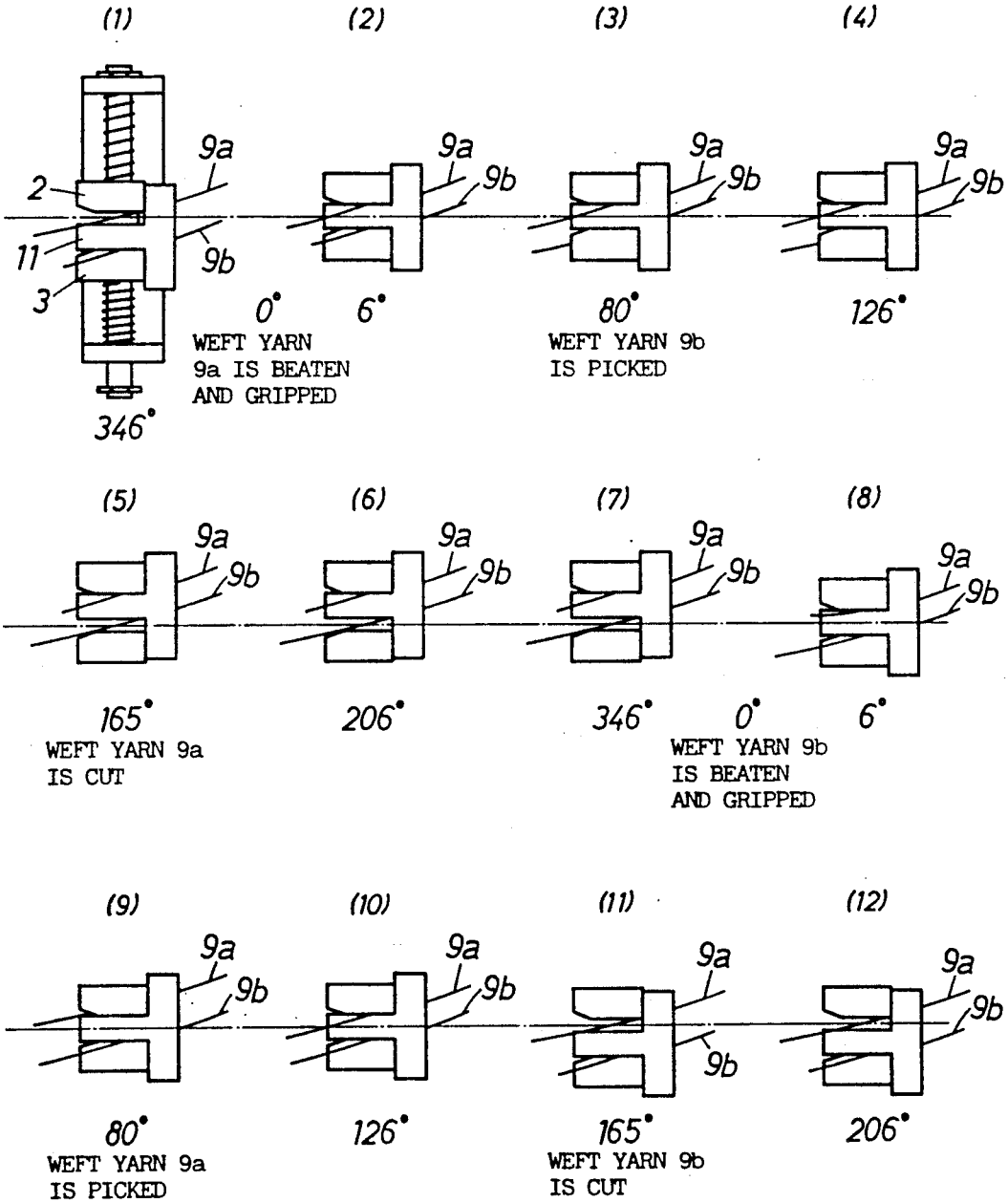
FIG. 7 is a diagrammatic view illustrating the operation of the picking apparatus in accordance with a two color alternate pick weave (a color pattern $1\times1$)

FIGS. 7 (1) to (12) show a picking operation performed by the picking apparatus over respective crank angles of the cam 22 in accordance with the color pattern 1×1. FIGS. 7 (1) to (12) correspond to operating stages (1) to (12).

(1) When the slider 4 is at its lowest position, a weft yarn 9b has been gripped between the griping body 3 and the gripper 11. The weft yarn 9b has been cut by the yarn cutter 14 so as to be severed from the woven cloth 9. A next picked weft yarn 9a is beaten and guided into the open space defined between the gripping body 2 and the gripper 11. The guiding of the weft yarn 9a is effected by a reed blade adjacent to the opening of the reed 35 or an L-shaped yarn guide hook 36 attached to the sley 34 so as not to interfere with the picking operation. At this time, the weft yarn 9a still extends to a yarn package 38 through the yarn introduction slit 33 of the yarn guide 32.

(2) After the weft yarn 9a is beaten, the slider 4 returns to the middle position so that the weft yarn 9a is gripped between the gripper 11 and the gripping body 2. At this state, the weft yarn 9b is still gripped between the gripper 11 and the gripping body 3.

(3) (4) The finger 8b of the weft yarn selection device lowers to select the weft yarn 9b. The rapier 37 holds the weft yarn 9b at the position close to the crank angle of 80° and draws the weft yarn 9b which is held between the gripper 11 and the gripping body 3. Of course, the operation and design of the fingers 8a, 8b of the weft yarn selection device are in accordance with the color pattern 1×1.

(5) The slider 4 moves to its uppermost position close to the crank angle of 165°. At this time, the yarn cutter 14 cuts the weft yarn 9a at the side of the woven cloth 9. At the same time, an open space is defined under the gripper 11 of the slider 4.

(6) (7) The weft yarn 9b is guided through the open space while it is beaten.

(8) The slider 4 moves to its middle position after the weft yarn 9b is beaten so that the weft yarn 9a is still gripped between the first gripping body 2 and the gripper 11 and the weft yarn 9b is gripped between the second gripping body 3 and the gripper 11. The weft yarn 9b still extends to the woven cloth 9.

(9) (10) The weft yarn 9a is drawn by the rapier 37 when the finger 8a of the weft yarn selection device is located at a position closely corresponding to the crank angle of 80°.

(11) (12) The slider 4 moves to its lowest position. The yarn cutter 14 cuts the weft yarn 9b between the movable blade 12 and the fixed blade 13. At this time, an open space is defined over the gripper 11. Thereafter, the operation returns to stage (1) nearly at the time when the weft yarn is beaten.

In the steps of the picking operation, the weft yarns 9a, 9b are picked one after the other to form a 1×1 weaving texture.

Figure 8:
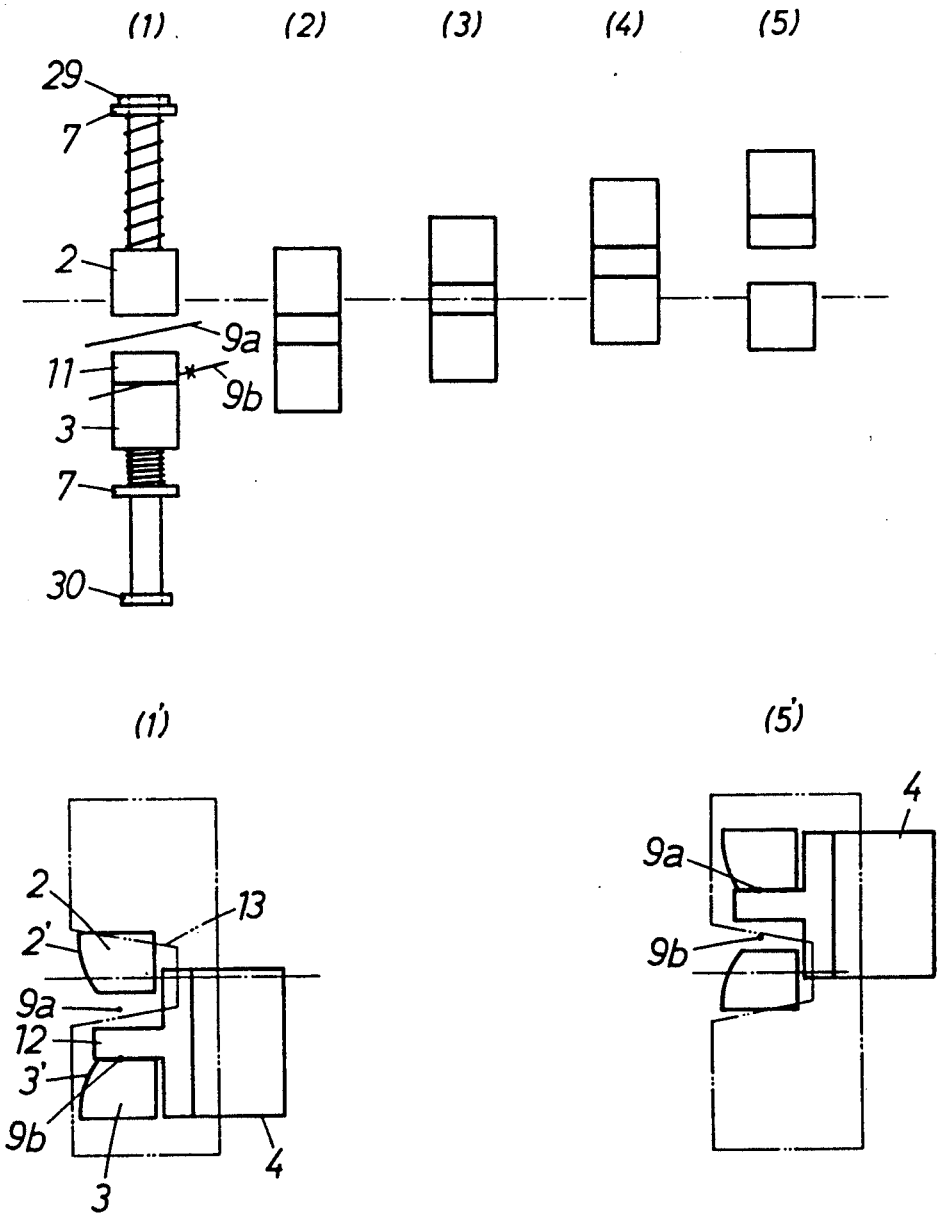
FIG. 8 is a diagrammatic view illustrating the operation of a picking apparatus of a rapier loom according to a second embodiment of the present invention.
Figure 9:
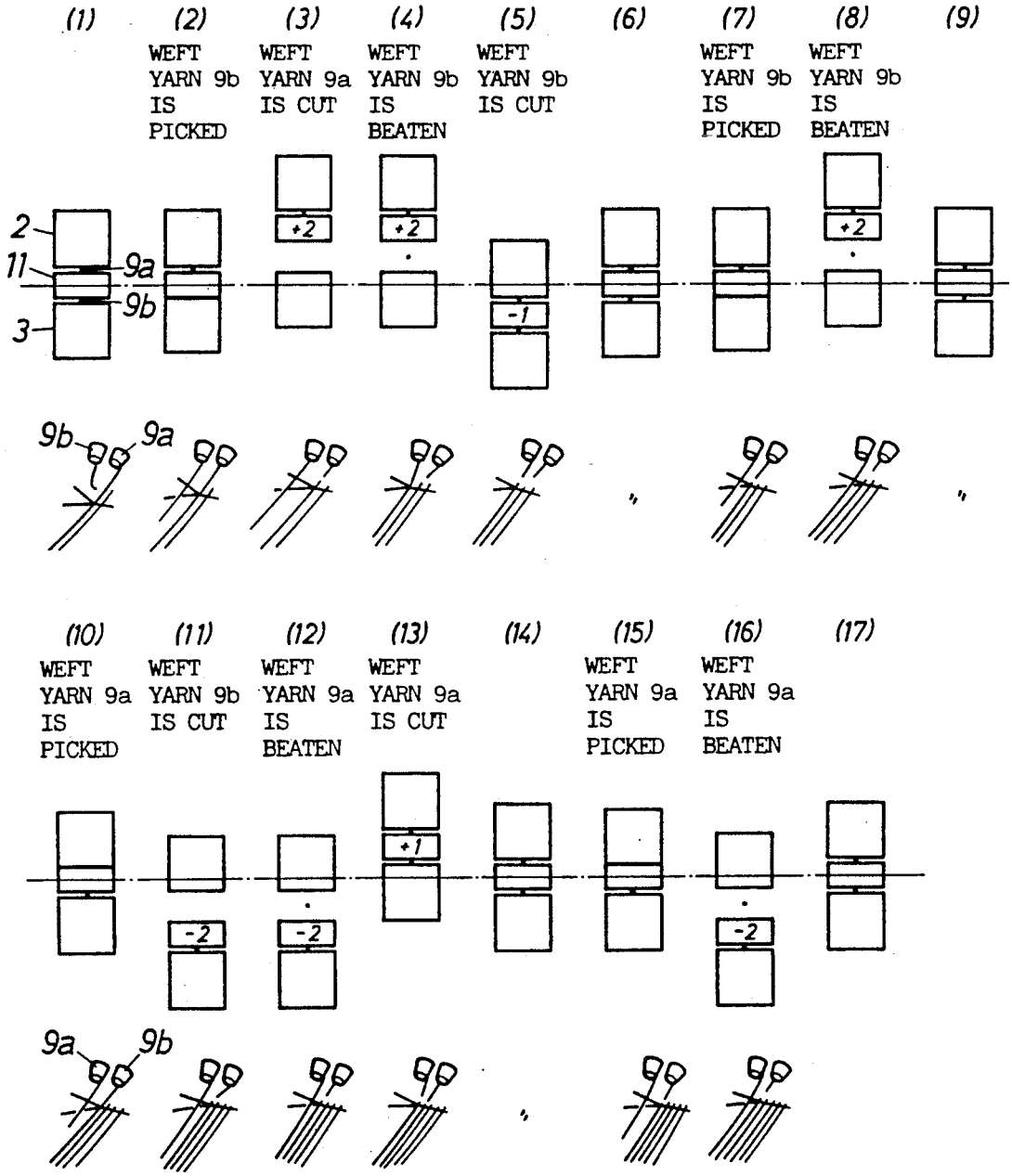
FIG. 9 is a diagrammatic view illustrating the operation of the picking apparatus in accordance with a two color alternate two pick weave a color pattern $2\times2$)
Figure 10:
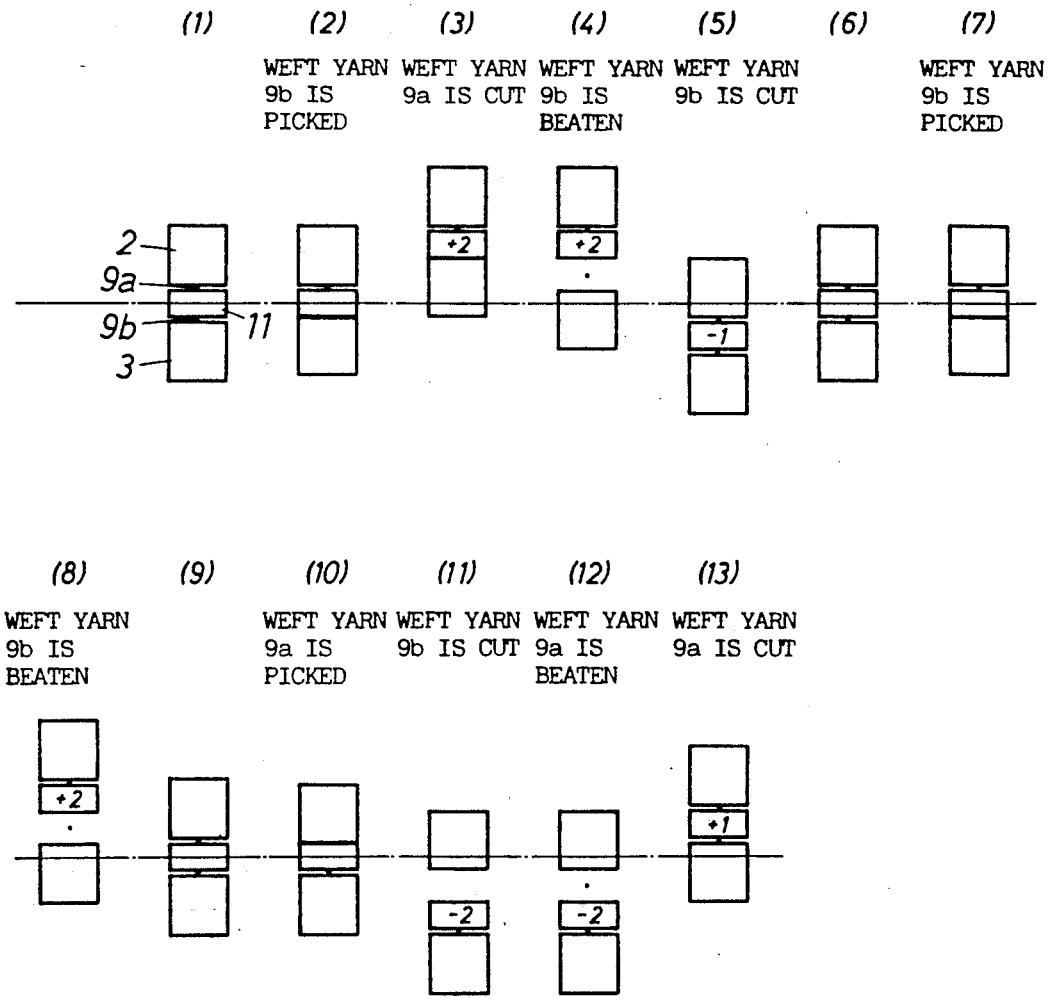
FIG. 10 is a diagrammatic view illustrating the operation of the picking apparatus according to another color pattern.

Second Embodiment (FIGS. 8 to 10)

A second embodiment of the picking apparatus of a rapier loom according to a second embodiment will be described with reference to FIGS. 8 to 10. In the second embodiment, a two color alternate two pick wave (a color pattern 2×2) or a two color alternate pick weave (a color pattern 2×1) is carried out, namely, one of the at least two weft yarns 9a, 9b is successively picked. The two color alternate two pick weave means that the weft yarn 9a is successively picked two times and then the weft yarn 9b is successively picked two times during one cycle of the picking operation. The yarn cutter 14 comprises the movable blade 12 fixed to the gripper 11 of the slider 4 and the fixed blade 13 fixed to the fixed blade bracket 31.

FIGS. 8 (1) to (5) show a picking operation performed by the second embodiment of the picking apparatus, in which each figure shows the location of the gripper 11 and the gripping bodies 2, 3 during each operating stage.

The slider 4 moves, as illustrated in FIGS. 8(1) to 8(5), up and down in five stages by a cam 22 which has a different contour from that of the cam in FIG. 5 given the same timing. The slider can be assumed to be at its middle position in stages (2)–(5). At stages (1) and (5), there is an open space defined over the gripper 11 and under the gripper 11, respectively. During stages (2) to (4), the weft yarns 9a, 9b are gripped by the gripper 11 and the first and the second gripping bodies 2, 3. At each of the stages except stage (3), one of the weft yarns 9a, 9b can be cut. That is, the weft yarn 9b is cut from stages (1) through (3) to stage (4) or (5) and the weft yarn 9a is cut from stages (5) through (3) to stage (2) or (1).

The positional relations between the fixed blade 13 and the gripper 11 and the first and second gripping bodies 2, 3 are illustrated in FIGS. 8 (1') and (5'). Inasmuch as the yarn guide surfaces 2', 3' of the gripping bodies 2, 3 are curved at the front portions of the gripping bodies 2, 3, the weft yarns 9a, 9b are guided into the open spaces with assurance. The yarn introduction slit 33 of the yarn guide 32 has the same size as the opening of the fixed blade 13.

FIGS. 9 (1) to (17) show a picking operation according to a 2×2 color pattern in which each figure shows a respective operating stage. With the color pattern 2×2, the reduction gear ratio of the cam shaft 21 relative to the main shaft of the loom is set to be 1:4.

During the stages (1) to (9), the weft yarn 9b is picked successively two times and beaten. After being beaten, the weft yarn 9b is cut at the stages (5) and (11).

During the stages (10) to (17), the weft yarn 9a is picked successively two times and beaten, and is cut at the stages (13) and (3).

FIGS. 10 (1) to (13) show a series of picking operations in accordance with two color alternate two pick x one pick weave (a color pattern 2×1) in which each figure shows the location of the gripper 11, the gripping bodies 2, 3 and the weft yarns 9a, 9b during a respective operating stage. With the color pattern 2×1, the reduction gear ratio of the cam shaft 21 relative to the main shaft of the loom is set to be 1:3. Two color alternate two pick x one pick weave (the color pattern 2×1 means that the weft yarn 9b is successively picked two times and then the weft yarn 9a is picked one time during one cycle of the picking operation. In the embodiment illustrated in FIG. 10, after the weft yarn 9b is picked two times during stages (1) to (5) and (6) to (8), the weft yarn 9a is picked one time during stages 9) to (13) to complete one cycle of the picking operation. During the stages (1) to (13), the picking apparatus 1 repeats the operation successively so as to grip the weft yarns 9a, 9b, and guide the weft yarns 9a, 9b to the open spaces in response to the cutting and beating operation.

The picking operation according to the second embodiment differs from the first embodiment in that when one of the weft yarns 9b, e.g. is picked successively two times, the first picked weft yarn 9b is cut by the movement of the gripper 11 moving to the stage (2) position at which the crank angle is about 30° while the weft yarn 9a is griped. After this, the slider 4 moves to its middle position before the weft yarn 9b is picked for a second time. Then, the slider 4 is moved to its middle position at the stage (3) but may be located at stage (2) or (4).

Third Embodiment (FIGS. 11 to 14)

A picking apparatus of a rapier loom according to a third embodiment of the present invention will be described with reference to FIGS. 11 to 14.

Figure 11:
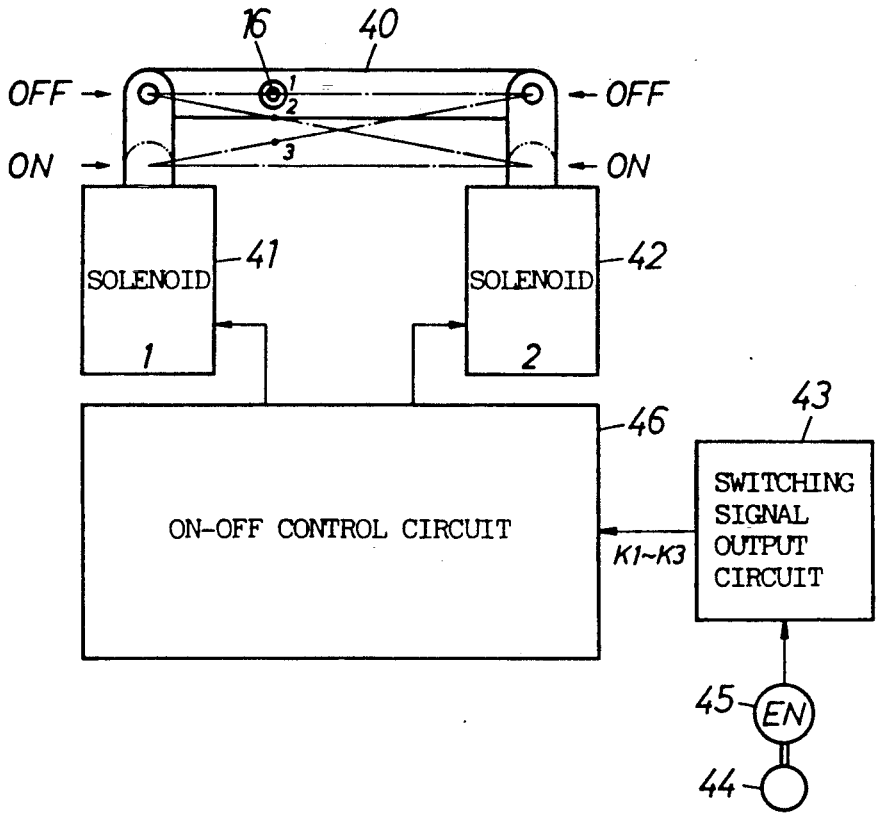
FIG. 11 is a schematic view of a driving means according to a third embodiment of the present invention.
Figure 12:
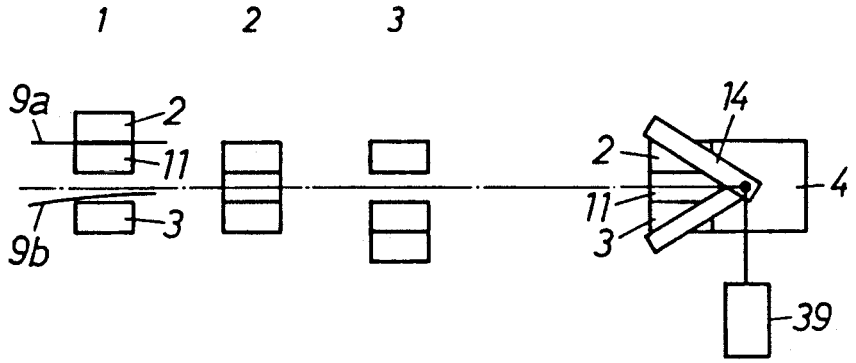
FIG. 12 is a schematic view of a gripper, a slider and a yarn cutter respectively constituting the driving means in FIG. 11.

The driving means 5 comprises, as illustrated in FIG. 11, first and second solenoids 41, 42 and the like. The yarn cutter 14 is, as illustrated in FIG. 12, provided separately from the picking apparatus 1 whereby the weft yarns can be picked in accordance with two color free pick weave (a color pattern AT WILL), namely, the weft yarns 9a, 9b can be picked at will.

The yarn cutter 14 is disposed adjacent to the woven cloth 9 opposite the picking apparatus 1. The yarn cutter 14 is connected to a driving portion 39 as to cut the weft yarn one time before the weft yarn is picked, i.e. during the period after the beating operation and before the picking operation.

The slider 4 is in its middle position at the start of the picking operation to grip both the weft yarns 9a, 9b and moves to its uppermost or lowest when the beating operation is carried out to thereby form the open space for receiving the picked weft yarn 9a or 9b. For example, the slider 4 is set to be at its middle position at crank angles of between 6° to 126°. The slider 4 is at its upper or the lower position except during that period mentioned above so that the slider 4 is ready to receive the weft yarns 9a or 9b to be beaten. The yarn cutter 14 operates at crank angle of about 30° to cut either of the weft yarns 9a or 9b.

As illustrated in FIG. 11, the solenoids 41, 42 are connected to the lever 40 at the distal ends of the rods thereof. A connecting pin 16 is fixed on the lever 40 at a position displaced from the center of the lever 40. Positions 1, 2, 3 of the connecting pin 16 as illustrated in FIG. 11 correspond to positions 1, 2, 3 of the gripper 11 of the slider 4. The slider 4 can move to three positions as illustrated in FIG. 13 on the basis of the on or off control of the two solenoids 41, 42.

When the two color free pick weave is effected according to a color pattern such as 9a→9b→9a→9b→9b as illustrated in FIG. 14, output patterns of switching signals K1 to K3 are preliminarily input and stored in a switching signal output circuit 43. The switching signal output circuit 43 receives a crank angle signal during the weaving operation from an encoder connected to a main shaft 44 of the loom and provides the corresponding switching signals successively to an on-off control circuit 46. The on-off control circuit 46 selectively turns the solenoid 41 or 42 on or off in response to the switching signals K1 to K3 to thereby place the lever 40 horizontally or incline the lever 40 in any direction so that the connecting pin 16 is adjusted to one of three positions at respective levels.

Figure 15:
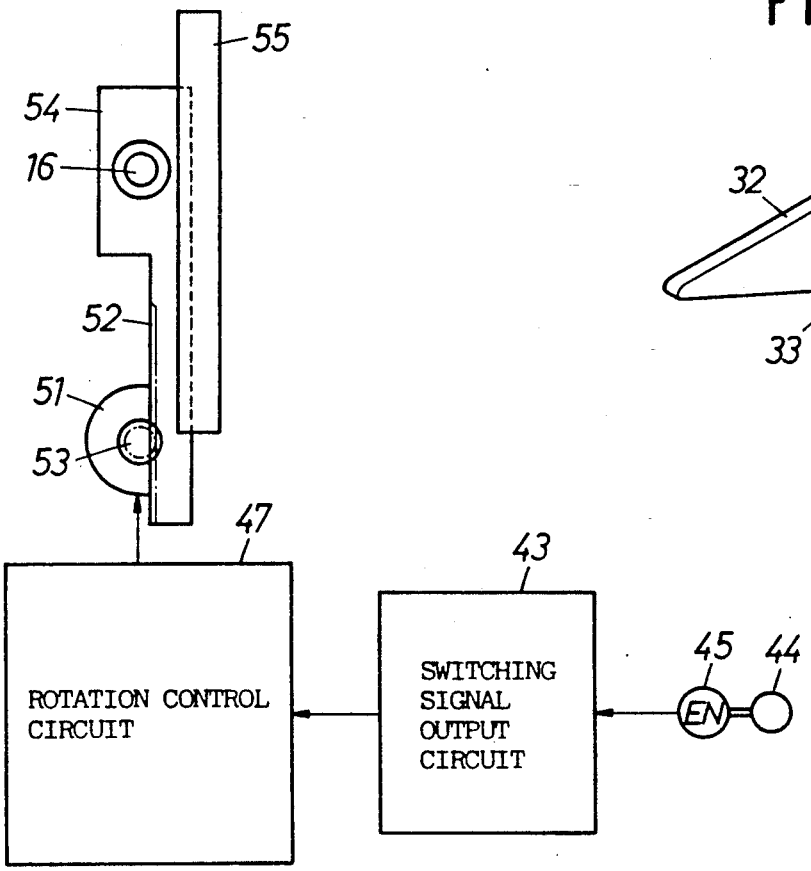
FIG. 15 is a front elevational view of a driving means according to a fourth embodiment of the present invention.
Figure 16:
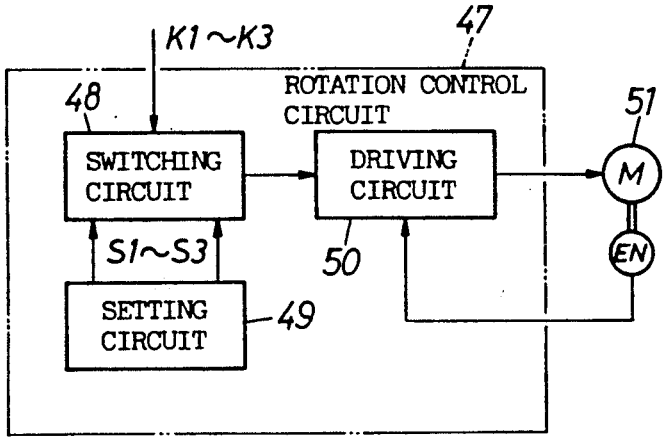
FIG. 16 is a block diagram of a rotation control circuit in FIG. 15.

Fourth Embodiment (FIGS. 15 to 16)

A picking apparatus of a rapier loom according to a fourth embodiment will be described with reference to FIGS. 15 and 16. In the fourth embodiment, the slider 4 is electrically and directly driven so that the weft yarns 9a, 9b can be picked at will in accordance with the two color free pick weave.

The switching output circuit 43 operates in the same way as that of the third embodiment. A switching circuit 48 in a rotation control circuit 47 receives driving signals S1 to S3, corresponding to the switching signals K1 to K3, from a setting circuit 49 upon the reception of the switching signals K1 to K3 from the switching signal output circuit 43 and provides the driving signals S1 to S3 to a driving circuit 50. The driving circuit 50 drives a pulse motor 51 which moves the slider 4 up and down in between the three positions 1, 2 or 3 as illustrated in FIG. 12. The rotary motion of the pulse motor 51 is changed to the vertical motion of the connecting pin 16 of a slider 54 along a rail 55 by a rack 52 and a pinion 53.

Figure 17:
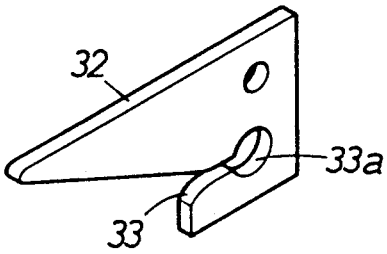
FIG. 17 is a perspective view of a yarn guide according to a modified embodiment of the present invention.

Modified Embodiment (FIG. 17)

The picking apparatuses of the rapier loom according to the first to fourth embodiments set forth above are applicable for use with the two-color yarns but may be utilized for picking four-color weft yarns. In the picking operation of four-color weft yarns, two picking apparatuses are disposed in two stages at upper and lower positions, and the two picking apparatuses per se are moved up and down in response to the selected weft yarn so that the picking apparatuses are positioned for carrying out the picking operation. It is a matter of course that the driving means for driving the apparatuses comprises the cam, the lever mechanism and the rotation control device of the motor as employed in the first to fourth embodiments. In each picking apparatus, the open spaces defined between the gripper 11 and the first and the second gripping bodies 2, 3 are located in the plane in which the cloth fell lies so that each picking apparatus can carry out the necessary operation. Although the gripping bodies 2, 3 are movable linearly up and down according to the first to the fourth embodiments, the gripping bodies may be movable up and down along a curvilinear path. For example, the gripping bodies 2, 3 may be provided at the distal ends of two levers which swing about one point.

It is preferable that the gripper 11 of the slider 4 and the gripping bodies 2, 3 cross the plane in which the cloth fell lies at the gripping surfaces thereof to minimize the loss of the weft yarn. However, the gripping surfaces of the gripper 11 of the slider 4 and the gripping bodies 2, 3 may be positioned slightly closer to the winding side or the let off side than the plane in which the cloth fell lies. When the gripping surfaces are positioned close to the winding side, a yarn pusher 36 is provided at the sley 34 so that the weft yarn end is forcibly guided to the open space defined between the gripper and the gripping bodies 2, 3.

The yarn introduction slit 33 of the yarn guide 32 may define a hook shaped groove 33a as illustrated in FIG. 17 so that the weft yarn 9a or 9b assuredly enters the grooves 33a when they are gripped. When the weft yarn 9a or 9b enters the groove 33a, the weft yarn 9a or 9b cannot slip therefrom even if a forward force is applied thereto so that the weft yarn 9a or 9b is gripped and cut with assurance.

Although the invention has been described in its preferred form with a certain degree of particularity, it is to be understood that many variations and changes are possible in the invention without departing from the scope thereof.

What is claimed is:

1. In a picking apparatus of a rapier loom having a weft selection device including first and second fingers operative to respectively select a weft yarn to be picked, a device for gripping and cutting weft yarns comprising:

a yarn cutter;

first and second gripping bodies disposed in a vertically opposed relation to one another between the weft selection device and said yarn cutter, guide means for supporting said first and said second gripping bodies in a manner which allows the gripping bodies to move up and down in the apparatus, and urging means for exerting forces on said gripping bodies which urge the gripping bodies toward one another;

a slider having a gripper interposed between said first and said second gripping bodies, said slider being movable between a lowest position at which the gripper engages said second gripping body and is spaced from said first gripping body, a middle position at which the gripper engages both of said gripping bodies, and an uppermost position at which the gripper engages said first gripping body and is spaced from said second gripping body; and driving means for moving said slider to one of said lowest and said uppermost positions thereof during a period in the operation of the loom in which a weft yarn is beaten, and for moving said gripper to said middle position thereof prior to a period in the operation of the loom in which a weft yarn is picked, in accordance with a desired color pattern of a fabric to be woven in the loom.

2. In a picking apparatus of a rapier loom, the device for gripping and cutting a weft yarn as claimed in claim 1, wherein said guide means for supporting said gripping bodies includes a bracket, and said yarn cutter includes a movable blade secured to said slider so as to be movable therewith, and a fixed blade secured to said bracket and confronting said movable blade.

3. In a picking apparatus of a rapier loom, the device for gripping and cutting a weft yarn as claimed in claim 1, and further comprising a yarn guide disposed to the side of said first and said second gripping bodies, said yarn guide defining a yarn introduction slit extending therethrough adjacent the gripper of said slider.

4. In a picking apparatus of a rapier loom, the device for gripping and cutting a weft yarn as claimed in claim 1, wherein said driving means includes a lever pivotably supported in the apparatus and operatively connected to said slider, and a cam rotatably supported in the apparatus, said cam being operatively engaged with said lever so as to pivot the lever during rotation of the cam, and said cam being synchronously connected to a rotary drive of the loom so as to be rotated thereby.

5. In a picking apparatus of a rapier loom, the device for gripping and cutting a weft yarn as claimed in claim 1, wherein said driving means includes a lever having opposite ends and operatively engaged with said slider between said ends thereof, first and second solenoids connected to said lever at the ends thereof, respectively, and a switching generating circuit operatively connected to said solenoids and to a main rotary shaft of the loom for generating switching signals in synchronism with the rotation of the shaft and for operating said solenoids under the control of said signals.

6. In a picking apparatus of a rapier loom, the device for gripping and cutting a weft yarn as claimed in claim 1, wherein said driving means includes a rack and pinion connected to said slider, a pulse motor for rotating said pinion to reciprocate said rack, and a switching generating circuit operatively connected to said pulse motor and to a main rotary shaft of the loom for generating switching signals in synchronism with the rotation of the shaft and for operating said pulse motor under the control of said signals.

7. In a picking apparatus of a rapier loom having a weft selection device including first and second fingers operative to respectively select a weft yarn to be picked, a device for gripping and cutting weft yarns comprising:

yarn cutting means for cutting weft yarns, a plurality of sets of first and second gripping bodies, the first and the second gripping bodies of each of said sets being deposed in a vertically opposed relation to one another, said sets of griping bodies being vertically spaced from one another in an area of the loom defined between the weft selection device and said yarn cutting means, respective guide means for supporting said first and said second gripping bodies in each of the sets thereof in a manner which allows the gripping bodies to move up and down in the apparatus, and respective urging means for exerting urging forces on said gripping bodies in each of the sets thereof which urge the gripping bodies of each set toward one another;

a respective slider having a gripper disposed between said first and second gripping bodies of each of the sets thereof, each respective said slider being movable between a lowest position at which the gripper engages a said second griping body and is spaced form the first gripping body opposed thereto, a middle position at which the gripper engages both of the gripping bodies of the set, and an uppermost position at which the gripper engages said first griping body and is spaced from said second gripping body of the set; and driving means for selectively moving a respective said gripper to one of said lowest and said uppermost positions thereof during a period in the operation of the loom in which a weft yarn is beaten, and for moving said gripper to said middle position thereof prior to a period in the operation of the loom in which a weft yarn is picked, in accordance with a desired color pattern of a fabric to be woven with a number of pairs of yarns in the loom which correspond to the number of said sets of gripping bodies.

* * * * *